US005162855A

United States Patent [19]

Nakagama et al.

[11] Patent Number: 5,162,855

[45] Date of Patent: Nov. 10, 1992

[54] IMAGE FORMING APPARATUS HAVING TEMPERATURE SENSOR FOR ESTIMATING THE OFF TIME OF THE FUSER AS RELATED TO THE PLATEN GLASS TEMPERATURE

[75] Inventors: Kiyohari Nakagama, Musashimurayama; Satoshi Watanabe, Hachioji; Mitsugu Nemoto, Hino, all of Japan

[73] Assignee: Konica Corporation, Tokyo, Japan

[21] Appl. No.: 713,310

[22] Filed: Jun. 11, 1991

[30] Foreign Application Priority Data

Jun. 13, 1990 [JP] Japan ..... 2-154463
Jul. 20, 1990 [JP] Japan ..... 2-192042
Jul. 20, 1990 [JP] Japan ..... 2-192043

[51] Int. Cl.[5] ..... G03G 15/20; G03G 21/00

[52] U.S. Cl. ..... 355/285; 355/30; 355/75; 219/216

[58] Field of Search ..... 355/282, 208, 285, 286, 355/289, 290, 295, 75, 30; 219/216, 388

[56] References Cited

U.S. PATENT DOCUMENTS 4,551,007 11/1985 Elter ..... 219/216 X
4,603,245 7/1986 Yagasaki ..... 219/216
4,627,714 12/1986 Nazaki ..... 219/216 X
4,671,643 6/1987 Shigemura .
4,737,818 4/1988 Tanaka et al. .
4,905,051 2/1990 Satoh et al. ..... 355/290
5,032,874 7/1991 Matsuuchi ..... 355/285

*Primary Examiner*—Richard L. Moses
*Attorney, Agent, or Firm*—Finnegan, Henderson, Farabow, Garrett and Dunner

[57] ABSTRACT

A copying machine for reproducing an image with toner on a recording sheet. The copying machine has a photoreceptor to hold a latent image corresponding to the image on its surface, in which the surface is charged to a predetermined electric potential before holding the latent image. The latent image is developed with toner, transferred onto the recording sheet, and fixed on the recording sheet with heat. The heater of the copying machine heats up the fixing unit to a predetermined temperature, and terminates heating the fixing unit when an operation of the machine is ended. The copying machine has a capability to detect a temperature of the fixing unit and determining an interval between the time when the operation is ended and the time when the operation is restarted, based on the determined temperature of the fixing unit.

7 Claims, 11 Drawing Sheets

IMAGE FORMING APPARATUS HAVING TEMPERATURE SENSOR FOR ESTIMATING THE OFF TIME OF THE FUSER AS RELATED TO THE PLATEN GLASS TEMPERATURE

BACKGROUND OF THE INVENTION

The present invention relates to an image forming apparatus for use electrophotography, and particularly relates to speeding up the copying operation with regard to the electrostatic charge characteristic of the photoreceptor.

Image forming apparatuses for use with electrophotography are equipped with drum-like Se or OPC photoreceptors for image formation. The electric potential characteristic of ordinary photoreceptors will be described below.

FIG. 13 is a graph illustrating the electric potential characteristic of an OPC photoreceptor during the continuous operation, i.e., the making of more than one copy sheet.

OPC photoreceptors especially tend to have their electric potentials during first image forming cycle (the dotted line in FIG. 13) less than that of the reference electric potential (the chain line in FIG. 13). In this figure the reference electric potential Vs is a surface electric potential for forming a latent image in such a way that a print and a ground are separated by 0.2 print clarity.

To obtain a toner image providing a proper print clarity, the surface of the photoreceptor, which is being rotated, is charged and then discharged during preprocessing so that the photoreceptor can be conditioned to have the electric potential during first image forming cycle as high as the reference electric potential Vs. Then, the revolving photoreceptor goes through the image forming cycle in which charging, optical image formation, toner depositing, separation and toner fixing are carried out one after another in order. Finally, the surface of the photoreceptor is cleared of dust, residual toner and a residual electric potential during postprocessing.

However, the above-mentioned requirement for preprocessing, image forming and postprocessing creates an obstacle to speeding up the copying operation, when more than one copy sheet is produced continually e.g., when a book is being copied.

Therefore, we have attempted to improve the image forming processing with attention to the electric potential characteristic of the photoreceptor.

FIG. 11 shows relation between a period of non-operational time for a photoreceptor drum (represented by on the abscissa) and surface electrical potential (Vf) which is generated on the electrically charged photoreceptor drum when it is exposed to light reflected on a document whose reflection density (OD) is 0.2 . This is regarded as sensitivity corresponding to the non-operational interval of the photoreceptor drum.

For example, when a photoreceptor drum, which has been electrically charged to a condition of 700 V, is exposed with the above-described reflected light, the surface electrical potential generated on the surface of the drum becomes 300 V. Further when development bias voltage of 180 V is applied to the drum, an actual visible image is formed due to the resetting development voltage of 120 V, which is the difference between the surface electrical potential and the development bias voltage.

During the above-mentioned process, the surface electrical potential sometimes does not reach 300 V, depending on fatigue of the drum, even when the drum is exposed with the aforesaid reflected light. Specifically, a photoreceptor drum kept in a non-operational status for a period of 20 minutes has high sensitivity as shown in the FIG. 11. When it is electrically charged under the condition of 700 V and is exposed to the reflected light, its surface electrical potential (Vf) goes down to 270 V. However, this reduction takes place only in the first cycle after the non-operational time period, and the surface electrical potential of about 300 V occurs in the second cycle and thereafter (i.e., non-operation interval is zero).

Namely, as apparent from the FIG. 11, the surface electrical potential Vf on a photoreceptor, generated when it is exposed to the reflected light from a document, decreases gradually as a function of the length of time elapsed after the ejection of an image-transfer sheet, and the surface electrical potential is lower than Vd herein referred to as the boundary electric potential Vd after an elapsed time of about 10 minutes, which has as been discovered by the inventors of this invention. More specifically, we have discovered that, with the surface electric potential characteristic of the photoreceptor, it is possible to omit preprocessing without creating a difference of in the surface electric potential between the first copying operation and the second or later copying operation, and without impairing the proper print clarity as long as the surface electric potential Vf is higher than the boundary electric potential Vd. Even when more than one copy sheet is produced continually, sufficiently clear copy sheets can be produced by omitting preprocessing, executing the image forming and postprocessing, and then repeating the same operation. The boundary electric potential Vd is the surface electric potential of the photoreceptor by which it is decided whether preprocessing is necessary or unnecessary.

Therefore, an object of the present invention is to provide an image forming apparatus for producing copy sheets with proper print clarity while speeding up the copying operation.

Next, the platen glass in conventional image forming apparatuses can rise above a certain temperature level, harming the user physically and psychologically. It is therefore necessary to prevent this temperature rise by setting a lower CPM value (the CPM value is the number of copy sheets produced per minute) when the platen glass is expected to be hotter than a certain temperature.

For instance, when 600 copy sheets are produced by a conventional image forming apparatus with a room temperature 25° C. and an initial platen glass temperature 25° C., the CPM value of 20 copy sheets per minute is lowered to that of 15 copy sheets per minute when the platen glass reaches 68° C. (e.g., 500 copy sheets produced continuously). This lowering of the CPM value prevents a further temperature rise even if the remaining 100 copy sheets are produced immediately after the initial 500 an external. Then, clock or an internal clock in the CPU of the apparatus measures the time before the start of the next copying operation. If 600 copy sheets are produced again, the CPM value is lowered (more than one CPM value can be set) at the instant 400 copy sheets are produced, because of the residual heat.

Namely, while powdered, conventional image forming apparatuses estimate the temperature of the platen glass from the number of copy sheets which are produced from how long the copy operation is stopped, and from the room temperature. An appropriate CPM value is then selected. The apparatus can use either an independent clock or an internal clock in the CPU to measure time. Many conventional apparatuses have the room temperature set to 30° C., which is their specified maximum value.

In conventional image forming apparatuses described above, however, when the power is turned off, the clock or CPU stops, and therefore it is impossible to measure elapsed time after the copying operation is stopped (hereafter referred to as an "off interval"). Since the apparatus is totally reset once the power is turned off, starting the apparatus again by turning on the power immediately after the reset is likely to cause overheating, because of the underestimation of the temperature of the platen glass.

When a small number of copy sheets are produced intermittently by turning on and off the power in order to estimate the platen glass temperature it is necessary to obtain the value $T_0$ given by the following equation:

$$T_0=(T_1+T_2+T_3)$$

where $T_0$ results from adding first operation time $T_1$, an off interval $T_2$ and the second operation time $T_3$ occurring after the power is turned on again. Here, even if conventional apparatuses are capable of storing the operation time $T_1$ in memory, the failure to estimate an off interval $T_2$ make it impossible to obtain $T_0$.

An idea for coping with this problem has been to use what is called a backup power source and to measure the off interval by using the backup source when the power is turned off. This approach has not been feasible because it makes the whole apparatus more complicated and costly.

In order to prevent overheating there has been a simpler idea of mounting a temperature sensor near the platen. However, this is difficult to do it without blocking the light reflected from a document to be copied. Overcoming this difficulty has proved too expensive.

Therefore, a second object of the present invention is to provide an image forming apparatus capable of measuring the temperature of the platen glass without using a clock or a temperature sensor which were added specially for such measurement.

SUMMARY OF THE INVENTION

To achieve the above-mentioned first object, an image forming apparatus as a first embodiment of the present invention is equipped with fixing rollers for fusing and fixing by heat a toner image developed on a sheet of paper, a sheet discharge sensor for detecting a sheet of paper passed from the fixing rollers and a toner fixing temperature sensor, and includes off interval estimation means for estimating an off interval from the output from the toner fixing temperature sensor, first time measurement means for measuring the time between the turning on of the main power switch and the start of image formation and second time measurement means for measuring the time between the recognition of a last feed out signal and the turning off of the main power switch.

To achieve the above mentioned second object, a second embodiment of the present invention is provided with means for measuring the off interval after the image forming apparatus is stopped and means for using the off interval and the predetermined heating change characteristic of the platen glass to calculate the temperature of the platen glass without the help of a temperature sensor or a clock.

For measuring the above-mentioned off interval, no clock is needed since the means for measuring the interval, according to the present invention, is constructed so that the off interval can be calculated by using the information on the temperature at an appropriate location having conspicuous temperature rise in the image forming apparatus and by using the predetermined heating change characteristic of that location.

The accuracy of estimation of the off interval can be increased according to the present invention by specifying the fixing unit as the location having conspicuous temperature rise.

The temperature detected near the fixing unit and the predetermined heating change characteristic of the fixing unit are used in order to calculate the off interval after the image forming apparatus is stopped. And then the off interval and the predetermined heating change characteristic of the platen glass are used in order to calculate the temperature of the platen glass. Therefore, an image forming apparatus according to the present invention allows its platen glass temperature to be measured without the use of a temperature sensor or a clock.

Now, an explanation will be given on the principle with regard to the heating change characteristic used in an image forming apparatus which achieves the first and second objects of the present invention and which is also used in off interval measurement on which the apparatus is based.

Let the temperature be constant inside the image forming apparatus irrespective of the ambient temperature, and let the current temperature be T, the toner fixing temperature 190° C., the proportional constant K, the temperature inside the apparatus 25° C., the time constant $\eta$, the off interval $\tau$ and the undetermined constant C. Then, the heating change characteristic of the surfaces of the fixing rollers is expressed approximately as follows:

$$T(\tau)=Kexp(-\tau/\eta)+C\ (C)$$

FIG. 4 shows data obtained from measuring an image forming apparatus according to the present invention. Then:

$$\begin{aligned} T(0) &= K+C \\ &= 190^\circ\ C. \\ T(\infty) &= C \\ &= 25^\circ\ C. \end{aligned}$$

and since:

$$\begin{aligned} \therefore K &= T(0)-T(\infty) \\ &= 190-25 \\ &= 165 \end{aligned}$$

Thus:

$$T(\tau)=165exp(-\tau/\eta)+25 \quad (1)$$

Now:

$$\tau/\eta=1$$

Thus, in the heating change characteristic shown in FIG. 4, let:

$$exp\,(-\tau/\eta)=0.368$$

$$T(\tau)=86\ (^{\circ}C.)$$

Then, since:

$$\tau=10\ (\text{minutes})$$

the time constant $\eta$:

$$\eta=10$$

Now, considering the ambient temperature, from the equation (1)' the following is obtained:

$$T=165exp(=\tau/10)+25+\alpha \qquad (2)$$

where $\alpha$ is a correction reflecting the influence of air flow around the location having conspicuous temperature rise in the image forming apparatus and of the difference in temperature between the apparatus and the air outside the apparatus. For instance, $\alpha$ can be approximated as follows:

$$\alpha=(T_R-25)\,(1-exp(-\tau/20)$$

TR: room temperature

Let ordinary temperatures be:

$$T_R=10^{\circ},\ 20^{\circ},\ 30^{\circ}\ C.$$

Then, the estimation errors $\Delta T$ for T(10), T(20) calculated for the room temperatures are:

$\Delta T(10)\leqq\pm1$ minute $\Delta T(20)\leqq\pm2$ minutes

Therefore, the error occurring when the off interval is estimated from the temperature of the location having conspicuous temperature rise is at most about $\pm10\%$, which is small enough to allow time measurement with feasible accuracy. Further, it is possible to estimate how much such a time measurement error affects the processing control, in order to implement good control within the range free from the influence of such errors.

The principle used for measuring the temperature of the platen glass is similar to the principle explained above for measuring the off interval, using the heating change characteristic of the platen glass.

In other words, the correspondence between the temperature and the off interval both in the platen glass heating characteristic is determined in advance, and the characteristic is stored in memory in the form of a data map which can be referenced. Then, the temperature of the platen glass can be estimated from the off interval obtained by the above-mentioned method.

DETAILED DESCRIPTION OF THE INVENTION

In reference to the drawings, the first embodiment of the present invention will be described.

Figure 6A:
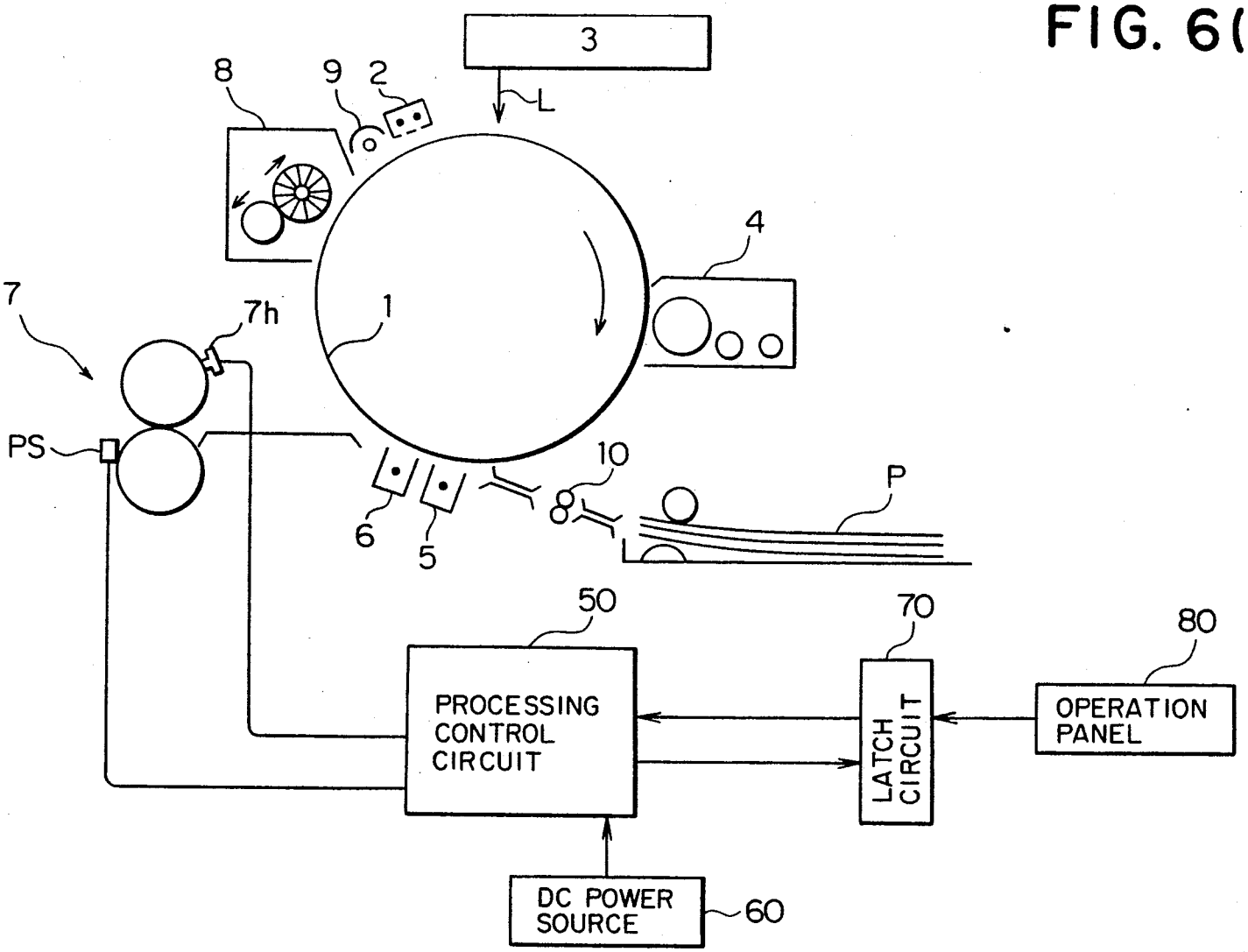
FIG. 6*a* is a schematic block diagram of an image forming apparatus according to the present invention.
Figure 6B:
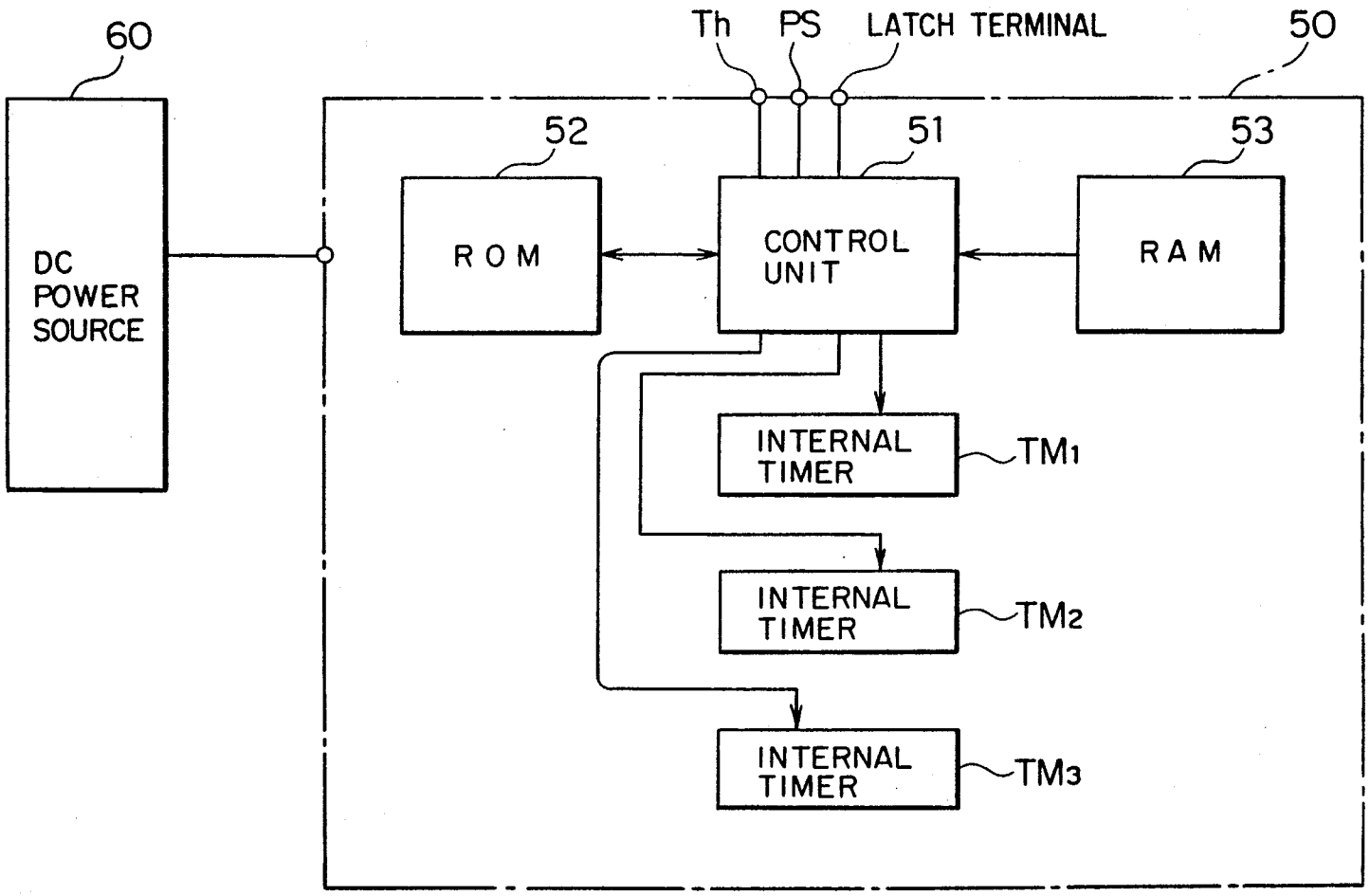
FIG. 6*b* is a functional block diagram of a processing control circuit according to the present invention.

FIGS. 6*a* and 6*b* are respectively functional block diagrams of an image forming apparatus and a processing control circuit according to the present invention.

The image forming apparatus 100 is composed of a drum-like photoreceptor 1 (hereafter referred to as the photoreceptor) which revolves in the direction shown by the arrow, a scorotron charger 2 for uniformly charging the photoreceptor 1, a scanning optical system 3, a developing unit 4, scorotron toner transfer unit 5, a separator 6, fixing rollers 7, a medium cleaner 8, a discharger 9, a DC power source 60, a latch circuit 70, an operation panel 80 and a processing control circuit 50.

The processing control circuit 50 is made up of a microprocessor, such as shown in FIG. 6*b*, in which there is a control unit 51 for performing various operations, internal timers $TM_1$ to $TM_3$, a ROM 52 storing software for image forming and a nonvolatile RAM 53 for storing data created during image forming. The ROM also stores data used to estimate a power-off interval, namely, a data table of temperature values and their corresponding time, allowing the processing control circuit 50 to obtain an off interval from the output from a toner fixing temperature sensor Th. In this embodiment, the table stored in the RAM and the process control circuit constitute one example of means for estimating an off interval.

The internal timer $TM_2$ measures the time between the turning off of the toner fixing lamp and the turning off of the main power switch. The internal timer $TM_3$ begins execution as soon as the process control circuit 50 is activated, and 55 seconds later issues an ON signal. The ON signal then releases the latch of the latch circuit 70, and a copy start signal from the operation panel 80 is issued to the processing control circuit 50. The internal timer $TM_3$ measures the time between the turning on of the main power switch and the execution of an image forming routine. In this embodiment, the internal timer $TM_3$ is one example of first time measurement means.

The time between the recognition of a last feed out signal and the turning off of the main power switch is used in one example of second time measurement means.

The photoreceptor 1 in this embodiment is an OPC photoreceptor whose reference electric potential Vs is 290 (V) and boundary electric potential Vd is 280 (V).

One of the fixing rollers 7 is a rubber roller having a toner fixing lamp (not illustrated) inside. As long as the main power switch is on, the temperature of the roller surfaces is kept at about 190° C., by control over the turning on and off of the toner fixing lamp. The fixing roller 7 for sheet discharge is provided with a sheet discharge sensor PS, so that every time a sheet passes the sensor it can issue a feed out signal, representing the detection of a sheet to the processing control circuit 50. The fixing roller 7 for heat fusing is provided with toner fixing temperature sensor Th for detecting the temperature of the roller surface, and the output from the toner fixing temperature sensor Th is issued to the processing control circuit 50.

Note that fixing roller 7 for heat fusing, which has a toner fixing lamp inside may be either the upper roller or the lower roller. Also note that the detection of roller surface temperature is not limited to the fixing roller 7 for heat fusing, because the same effect is achieved by detecting the temperature of the other roller having no heat source (i.e., not having a toner fixing lamp).

Now, the heating characteristic of the fixing rollers 7, which is an exclusive feature of this embodiment, will be described.

Figure 12:
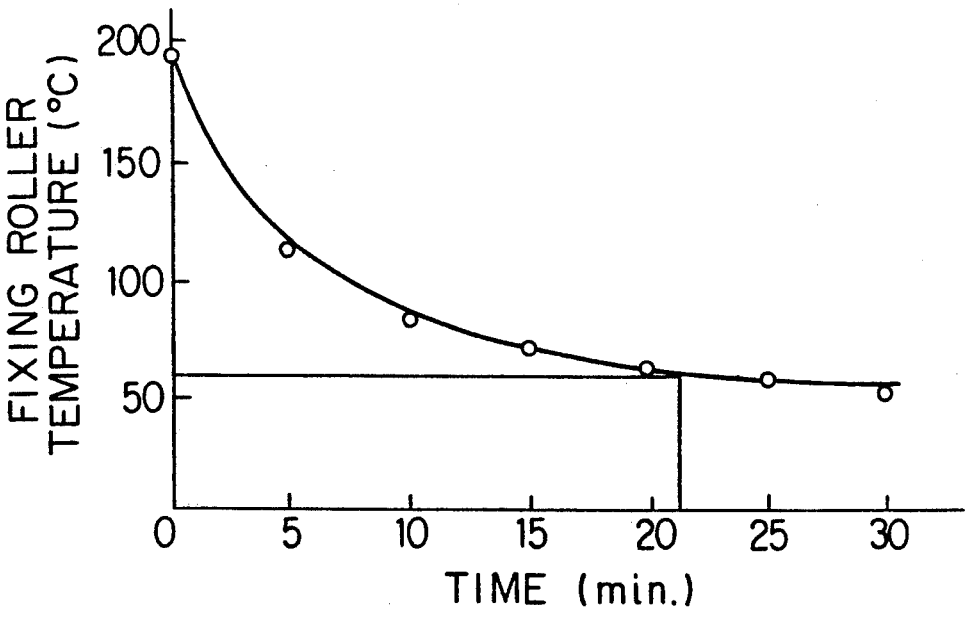
FIG. 12 is a graph illustrating the heating characteristic of fixing rollers for heat fusing which is a result of the detection by a toner fixing temperature: sensor according to the present invention.
Figure 13:
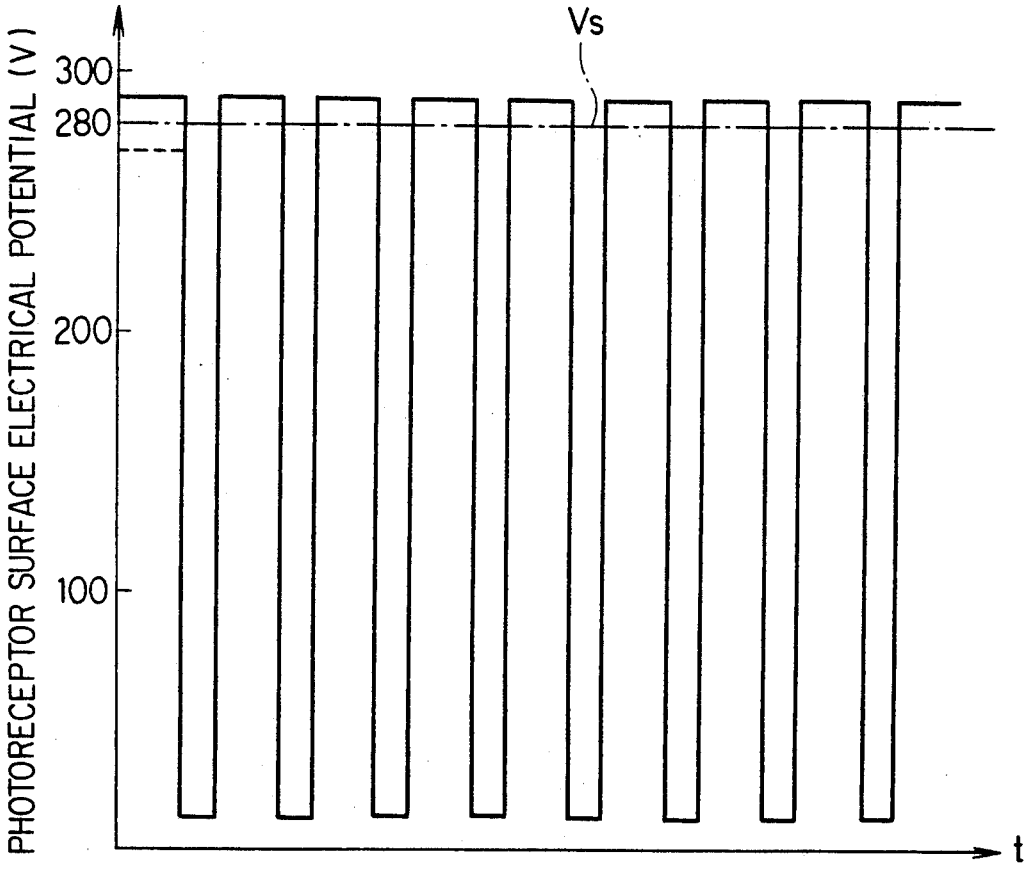
FIG. 13 is a graph illustrating the electric potential characteristic of an OPC photoreceptor during the continuous operation (i.e., the making of more than one copy sheet).

FIG. 12 is a graph illustrating the heating characteristic of the fixing roller for heat fusing which is a result of the detection by the toner fixing temperature sensor.

In FIG. 12, the vertical axis represents the temperature (in centigrade) of the fixing roller surfaces of this embodiment. The horizontal axis represents time (in minutes).

Figure 11:
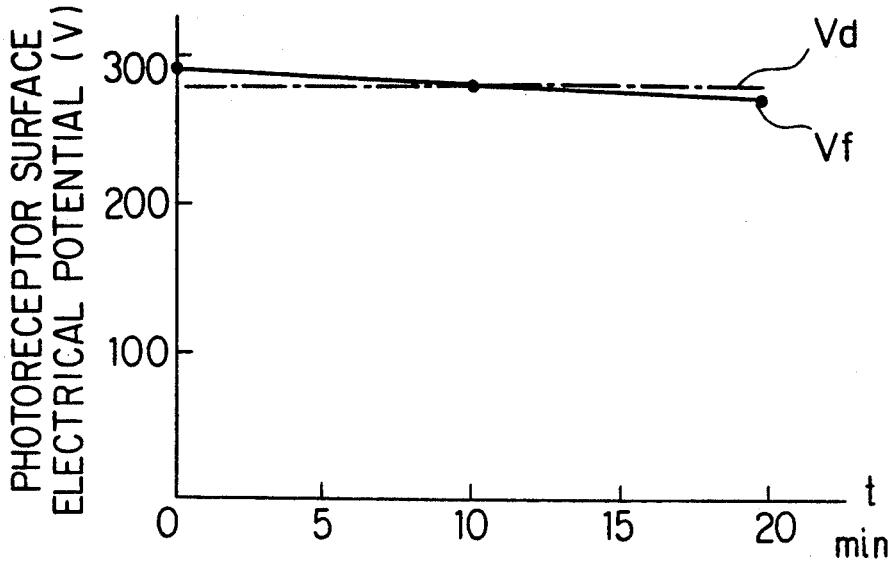
FIG. 11 is a graph illustrating the electrostatic charge characteristic of the OPC photoreceptor for use in ordinary analog copying machines.

The fixing rollers 7 have a fixing temperature of about 190° C. This temperature drops to 60° C. about 20 minutes after turning off the toner fixing lamp and leaving the rollers without power. As shown in FIG. 12, in the first 20 minutes, the temperature of the fixing roller surfaces drops in an exponential function. Thus the period for leaving the rollers without power can easily be estimated from the output from the toner fixing temperature sensor Th. As understood from this the image forming apparatus 100 in this embodiment is characterized by the capability of estimating the interval between the turning off of the toner fixing lamp and the turning on of the main power switch (for simplicity, hereinafter referred to as the off interval) from the electrostatic charge characteristic of the photoreceptor which is shown in FIG. 11 and the heating characteristic of the fixing rollers which is shown in FIG. 12.

Operation panel 80 is for setting the number of copy sheets to be produced and then starting the copying operation. Latch circuit 70 is for latching the copy start signal output from the operation panel 80 while the image forming apparatus 100 is being initialized. This circuit latches the copy start signal for about 55 seconds after the turning on of the main power switch (not illustrated), and then releases the latch, allowing the copy start signal from the operation panel 80 to be sent to the processing control circuit 50. The DC power source 60, provided with power by an AC power line, supplies about 5 VDC to the processing control circuit 50 when the main power switch is turned on.

Now, the image forming operation performed by the image forming apparatus 100 of this embodiment will be described.

Figure 1:
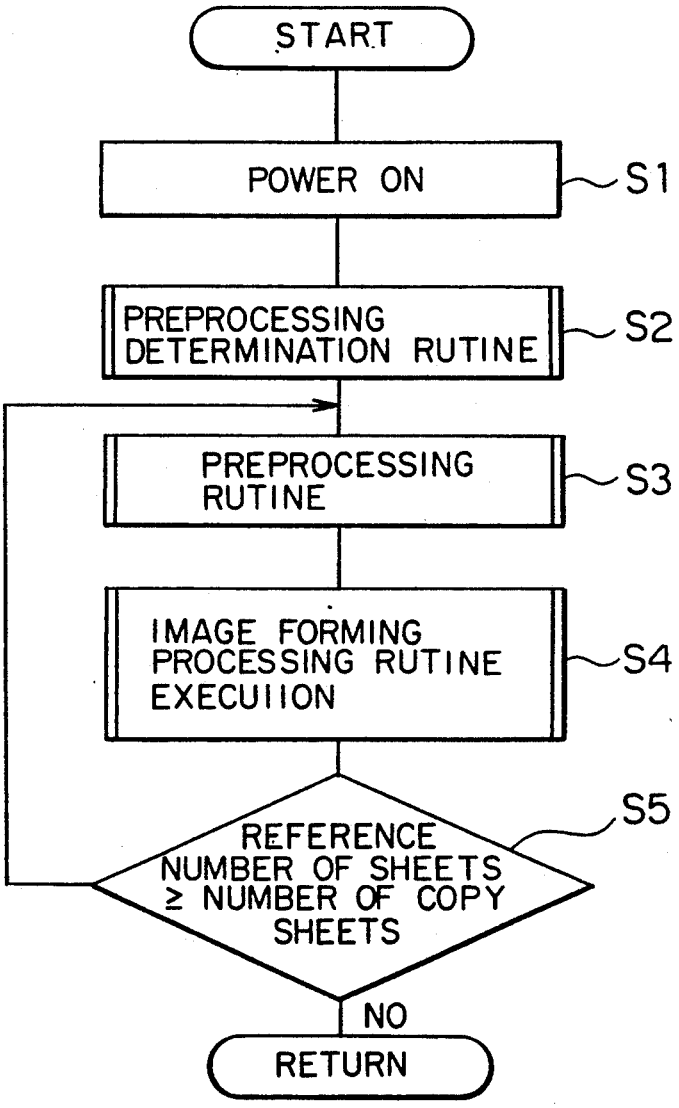
FIG. 1 is a flowchart of the main routine in image forming processing according to the present invention.

FIG. 1 is a flowchart of the main routine for image forming.

When the main power source (not illustrated) is turned on (at the step S1), the DC power source 60 is provided with power by an AC power line and then supplies power at about 5 VDC, which activates the processing control circuit 50.

The processing control circuit 50 in turn executes a preprocessing determination routine (at S2), a preprocessing routine (at S3), the image forming routine (at S4), repeating the steps S3 to S4 according to a reference number of sheets, and when all copy sheets are produced terminates the main routine.

The operation of each routine from S2 to S4 will be described below with reference to FIGS. 2 to 5.

Figure 2:
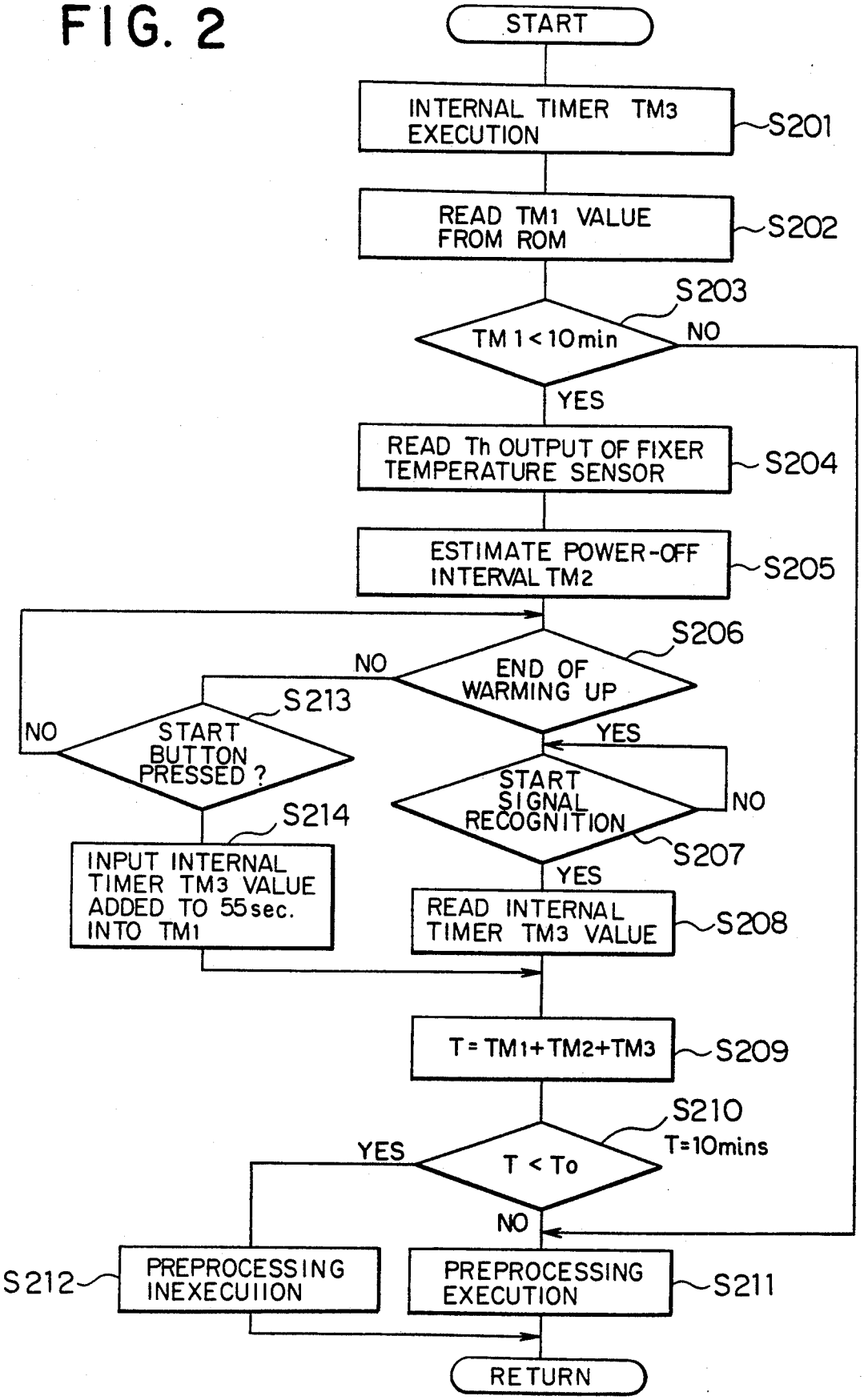
FIG. 2 is a flowchart of a preprocessing determination routine according to the present invention.

FIG. 2 is a flowchart of the preprocessing determination routine.

In this flowchart, when the routine is executed a preprocessing determination flag is used for deciding whether or not to execute the entire preprocessing routine. When this flag is on, the preprocessing routine is executed. When the flag is off, the routine is executed but not in its entirety, and control returns to the main routine.

The processing control circuit 50 executes the internal timer $TM_3$ (at S201), letting the timer measure time till the next execution of the preprocessing determination routine.

The processing control circuit 50 reads from the nonvolatile memory a time measurement made by the internal timer TM1 (at S202) and decides whether this time measurement $TM_1$ is shorter than 10 minutes or not (at S203).

If the time measurement TM1 is shorter than 10 minutes, the processing control circuit 50 reads the output from the toner fixing temperature sensor Th (at S204) and uses this output to obtain an off interval from the ROM (at S205). The processing control circuit 50 uses an output signal from the internal timer $TM_3$ to decide whether the apparatus is warmed up or not (at S206) and waits for a copy start signal to come from the latch circuit 70 (at S207). When the processing control circuit 50 recognizes the copy start signal, the circuit 50 reads the value of the time measurement TM3 made by the internal timer $TM_3$ (S208) and adds the time measurement TM1, the off interval TM2 and the time measurement TM3 to obtain time T (at S209). The processing control circuit 50 compares the time T with specified time $T_0$ (in this example 10 minutes) (at S210). If T is shorter than the specified time $T_0$, the preprocessing flag is turned off (at S211), the preprocessing determination routine is terminated, and control returns to the main routine.

If the time T is longer than the specified time $T_0$, the processing control circuit 50 turns the preprocessing flag on (at S211), terminating the preprocessing determination routine, and control returns to the main routine.

If the time measurement TM1 is longer than 10 minutes, as measured at step S203, (at S211), the processing control circuit 50 turns the preprocessing flag on. Then, the preprocessing determination routine is terminated, and control returns to the main routine.

Figure 3:
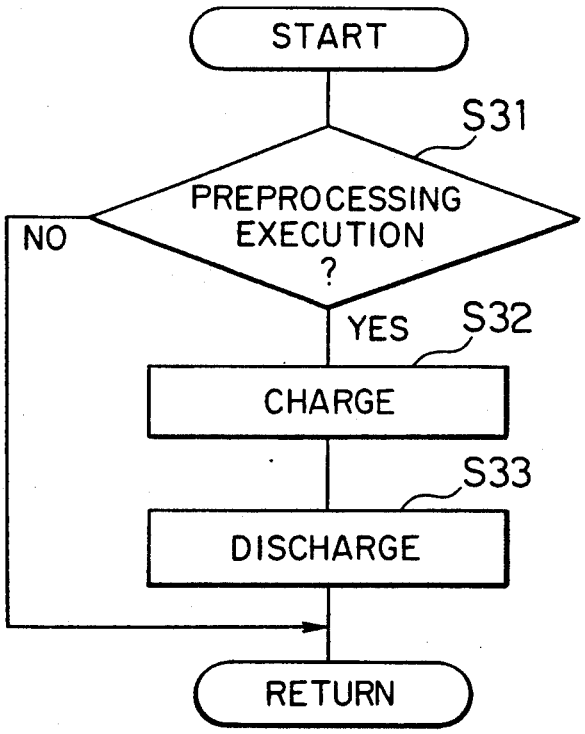
FIG. 3 is a flowchart of a preprocessing routine according to the present invention.

FIG. 3 is a flowchart of the preprocessing routine.

When the preprocessing routine is executed, the processing control circuit 50 decides about the condition of the preprocessing flag (at S31). If this flag is on, the revolving photoreceptor 1 is charged by the scorotron charger 2 (at S32), then the photoreceptor 1 is discharged by the discharger 9 (at S33) and control returns to the main routine. If the flag is off, control returns to the main routine without processing at steps S33 or S34. Thus, the preprocessing routine in this embodiment is provided with the function of deciding whether or not to execute itself according to the condition of the preprocessing flag, which helps greatly to speed up the copying operation.

Figure 4:
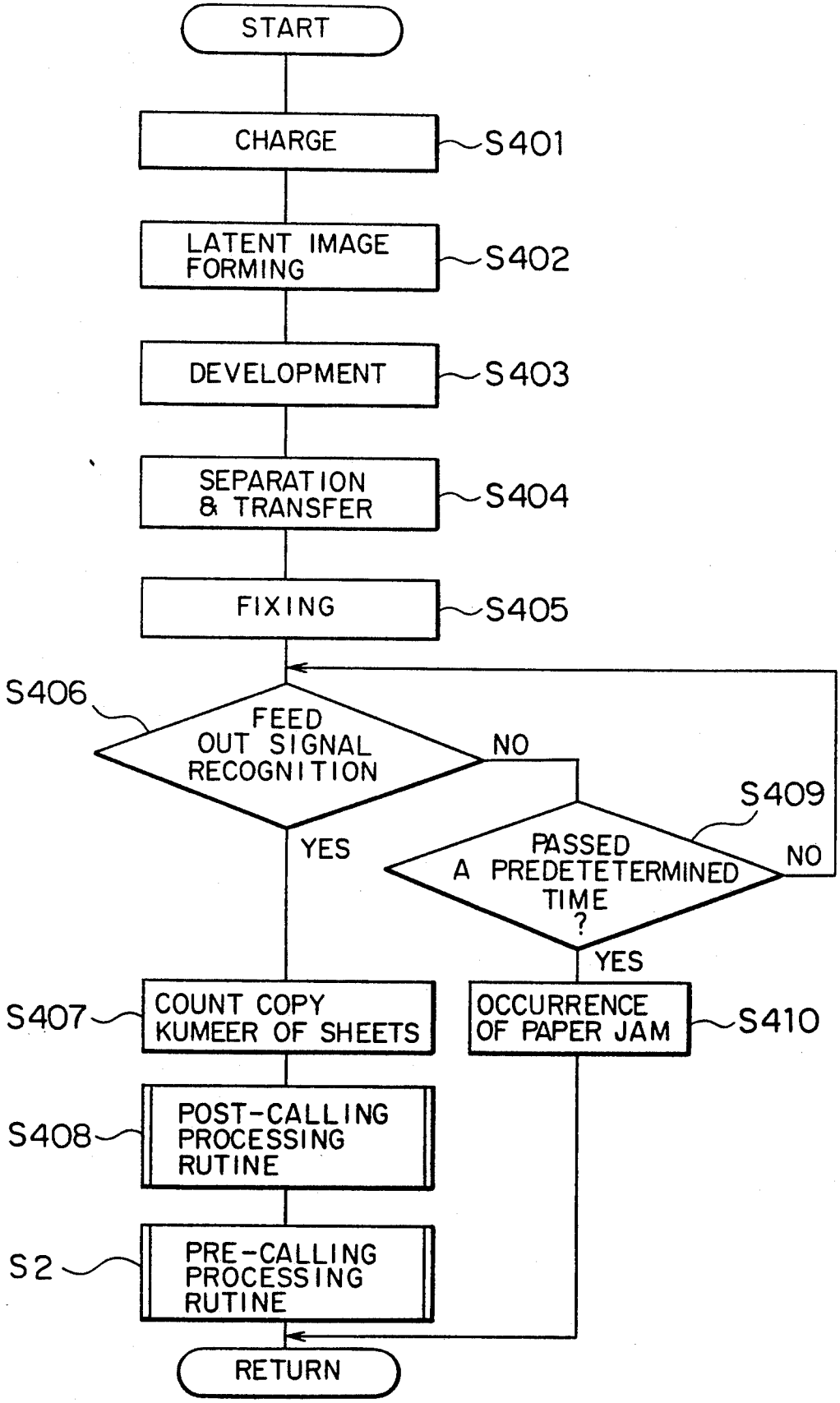
FIG. 4 is a flowchart of an image forming routine according to the present invention.

FIG. 4 is a flowchart of the image forming processing routine. When the image forming processing routine is executed (at S4), the processing control circuit 50 drives the scorotron charger 2 to charge the photoreceptor 1 revolving in the direction shown by the arrow in FIG. 6 (at S401). Then, exposure is performed by the scanning optical system 3 to form a latent image on the photoreceptor 1 (at S402). The processing control circuit 50 drives the developing unit 4 to develop a toner image from the latent image on the photoreceptor 1 (at S403). The processing control circuit 50 feeds paper P from a paper tray to a registration roller 10 with appropriate timing, drives the separator 5 and the toner transfer unit 6 to separate and transfer the toner image on the photoreceptor 1 onto the paper P (at S404). The paper P with the toner image transferred onto it is passed to the fixing rollers 7, which fix the toner image on the paper P (at S405) with pressure and heat, and discharge the paper sheet. Here, the paper P trips the sensor section of sheet discharge sensor PS, and then sensor PS issues a feed out signal to the processing control circuit 50.

Next, the copy sheet is counted (at S408). When the processing control circuit 50 recognizes the feed out signal, the circuit 50 executes a post-calling processing routine (at S407). When control returns from the post-calling processing routine, the processing control circuit 50 executes the preprocessing determination routine (at S2). After the execution of this routine, control returns to the main routine.

The processing at the steps 9 to 10 is a loop for detecting the occurrence of a paper jam. This processing is not directly related to the present invention, so its detailed description is omitted.

The preprocessing determination routine has already been described. But the post-calling processing routine will be described from now.

Figure 5:
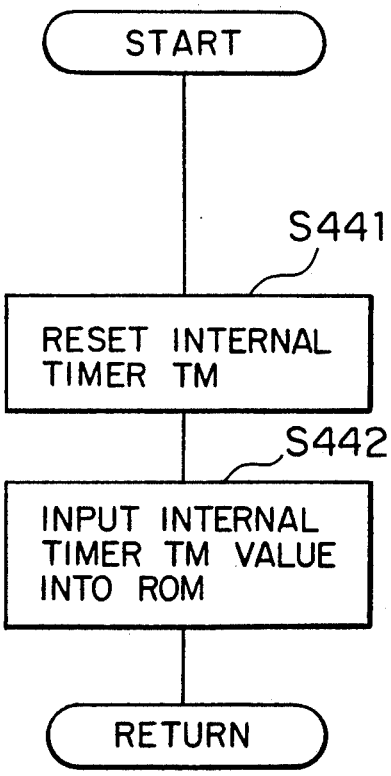
FIG. 5 is a flowchart of a post-calling processing routine according to the present invention.

FIG. 5 is a flowchart of the post-calling processing routine.

When executing the post-calling processing routine, the processing control circuit 50 resets the internal timer $TM_1$ (at S441). Then, the internal timer $TM_1$ resumes working, and writes its time measurement to the nonvolatile memory (at S442). This post-calling processing routine is a routine simply for resetting the internal timer $TM_1$ so that the internal timer $TM_1$ can measure the time between the recognition of a last feed out signal and the turning off of the main power switch. The internal timer $TM_1$ is reset every time the post-calling processing routine is executed. In other words, the time measurement TM1 written to the ROM is only meaningful as the first value read when the main power switch is turned on, because following time measurements read in the course of the continuous operation (i.e., the making of more than one copy sheet) represent the time taken to obtain one copy sheet, that is, the same as the value to be compared with a particular time in order to detect a paper jam.

With the image forming apparatus 100 in this embodiment, which is constructed in the above manner, it is possible to speed up the continuous operation of making more than one copy sheet by omitting any preprocessing after the first preprocessing, and it is also possible to produce copy sheets with proper print clarity.

When the copying operation is started in a particular length of time (10 minutes), for example, when a continuous operation of copying more than one copy sheet of documents (such as a magazine and a book) is performed with such a break within 10 minutes, the omission of preprocessing in this embodiment speeds up copy sheeting and still produces copy sheets with proper print clarity.

Preliminary processing skipped as stated above means practical stabilization of development voltage (Vs), and in order to solve this, several controls may be considered.

Charging voltage ($V_c$) to be applied to a photoreceptor, voltage attenuation ($\Delta V_L$) caused by light irradiation and development voltage (Vs) are related each other as shown in the following formula:

$$V_c - \Delta V_L = V_s$$

Namely, even when the photoreceptor is non-operational for a certain period of time and thereby the voltage attenuation ($\Delta V_L$) becomes greater, charging voltage ($V_c$) is lower and Vs is stabilized if the charging current to be applied on the photoreceptor is small. Further, when the amount of reflected light to be irradiated on the photoreceptor is small, $\Delta V_L$ can be stabilized apparently even when voltage attenuation ($\Delta V_L$) is greater.

Voltage V to be used for toner adherence, the aforesaid development voltage ($V_s$) and bias voltage ($V_B$) are related each other as shown in the following formula:

$$V = V_s - V_B$$

Namely, when bias voltage ($V_B$) is changed similarly to the aforesaid other conditions, voltage V for toner adherence can be kept constant, and thereby toner concentration can finally be maintained constant, even when development voltage ($V_s$) fluctuates.

From these characteristics when a photoreceptor is non-operational for a certain period of time due to the temperature change with elapsed time of a fixing roller of a copying machine, and thereby the voltage attenuation ($\Delta V_L$) caused by irradiation of the reflected light becomes greater, it is possible to keep voltage V for toner adherence constant by changing one or more of charging current (I), an amount of reflected light and bias voltage ($V_B$) during the first cycle of copying pause.

Now, the second embodiment of the present invention will be described.

Figure 7:
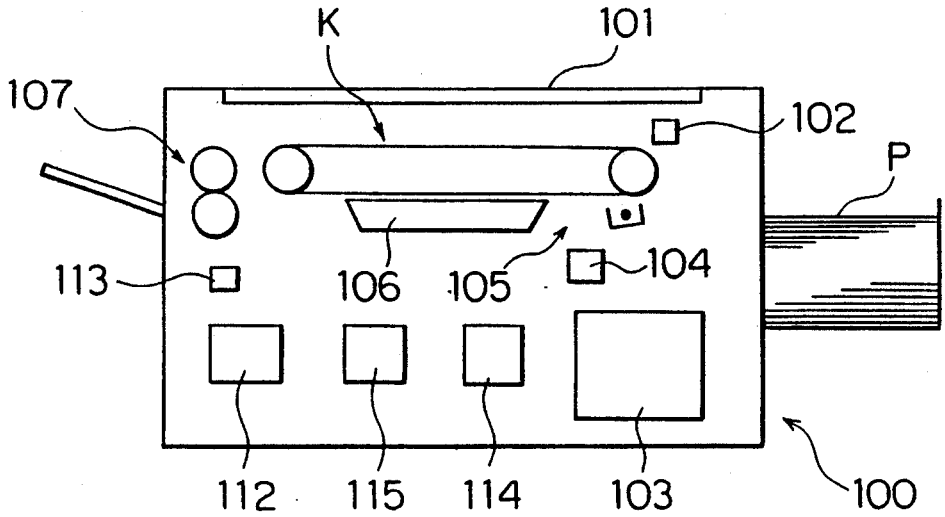
FIG. 7 is an illustration of the theoretical construction of an image forming apparatus of FIG. 6*a;*
Figure 8:
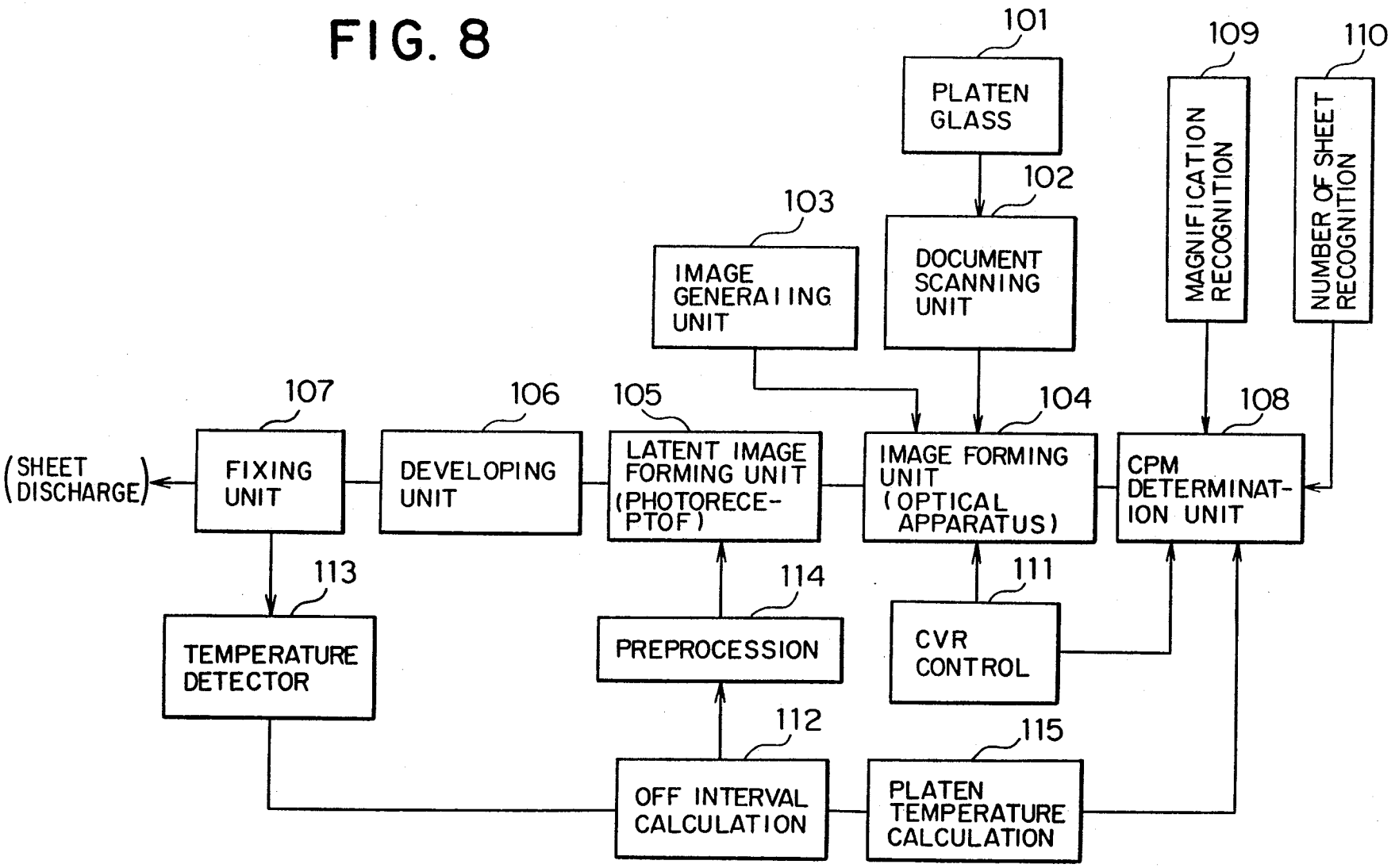
FIG. 8 is a block diagram of the theoretical construction of an image forming apparatus of FIG. 6*a;*

In FIGS. 7 and 8, the reference numeral 101 denotes platen glass. The platen glass 101 is fixed to the upper surface of the image forming apparatus 100. The platen glass 101 is constructed so that it supports a document to be copied so that the document can receive light emitted from a lamp installed in a document scanning unit 102, and then image information on the document can be output to an image forming unit 103.

The numeral 104 denotes an image generating unit for extracting data such as images, characters and graphic patterns, of an origin not related to copying operation, of the output from a particular memory or a particular signal transfer device (not illustrated), and also for outputting them to the image forming unit 103. When the image forming apparatus 100 is constructed only as a copying apparatus, the image forming unit 104 may be omitted. When it is constructed as an image printer, the platen glass 101 and the document scanning unit 102 may be omitted. The numeral 105 denotes a latent image forming unit provided with photoreceptor K (a drum or belt) to convert into a latent electrostatic-charge image an image formed by a light beam emitted by the image forming unit 104. When the off interval exceeds a specific length of time, the photoreceptor K is charged by preprocessor 114 so as to make the photoreceptor stable for a continuous copying operation.

The numeral 106 denotes a developing unit, which is constructed to deposit toner on a latent electrostatic-charge image formed by the latent image forming unit 105 on the photoreceptor K and then to convert the latent image into a toner image. The paper P onto which this toner image is transferred, and which is separated from the photoreceptor K, is passed to a fixing unit 107 where the toner image is fused and fixed by heat. Paper P is then discharged outside the image forming apparatus.

The numeral 108 is a CPM determination unit for determining the speed of producing copy sheets in copy sheets per minute in accordance to copy sheet production conditions such as the following:

(1) Copy magnification,
(2) The number of copy sheets to be produced continuously,
(3) CVR value (voltage at the lamp in a document scanning unit 102),
(4) Temperature of platen glass.

Regarding magnification in the information obtained by magnification recognition 109 is input to the CPM determination unit 108. Regarding the number of copy sheets to be produced continuously, the information obtained by sheet number recognition 110 is input to the unit 108. Regarding CVR value, the voltage at the document scanning unit lamp, which is determined by a CVR control 111, is input when the image forming apparatus 100 is initialized. For the magnification recognition 109, a value specified by the user is entered, and for the number of sheet recognition 110, a sheet count of the paper P is made.

Figure 9:
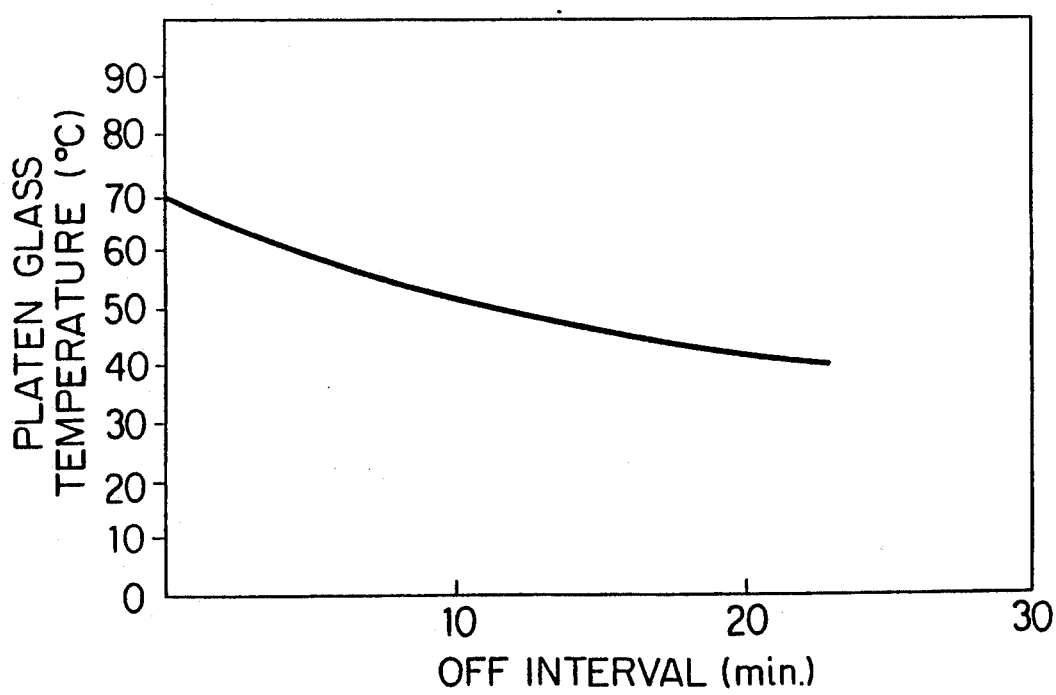
FIG. 9 is a graph illustrating the heating characteristic of a platen glass according to the present invention.

The temperature of platen glass may be detected by a temperature sensor mounted near the platen glass 101, but in this embodiment, as stated earlier the temperature is calculated by using the off interval obtained from the heating change characteristic of the fixing unit 107 and by using the predetermined heating characteristic of the platen glass. The numeral 112 denotes the off interval calculation in which the lapse of time after the image forming apparatus is stopped is calculated by using the information output from a temperature detector 113 mounted at an appropriate location having conspicuous temperature rise in the fixing unit 107 (in this embodiment such a location is on or near the surface of the fixing rollers) and by using the predetermined heating change characteristic of the location. In other words, the off interval calculation 112 is implemented by storing in memory the heating change characteristic of the location in the form of a map so that an off interval can be estimated from the information output from the temperature detector 113 by reversely using the map. Then, using to the off interval obtained by the calculation 112 a decision is made as to whether or not charging should be carried out in the preprocessing 114. And, according to the measurement shown in FIG. 9 the temperature of the platen glass is estimated by platen temperature calculation 115. So far the heating change characteristic has been described with regard to its theory.

In this embodiment, when the copying operation is performed, a document placed on the platen glass 101 is scanned by the document scanning unit 102, and then the image information is sent to the image forming unit 104. But when an image is produced without copying, the image generating unit 103 sends original image information to the image forming unit 104. On the other hand, a CPM value is established according to the output from the magnification recognition 109, sheet number recognition 110, CVR control 111 and platen temperature calculation 115.

Then, the latent image forming unit 105 converts into a latent electrostatic-charge image an image formed by a light beam on the photoreceptor K. The developing unit 106 converts this latent image into a toner image. The toner image, transferred onto paper P, is fixed by heat in the fixing unit 107, and then discharged outside the image forming apparatus. In the meantime, the temperature detector 113 measures the temperature at an appropriate location in the fixing unit 107. On the basis of this temperature, the off interval after the image forming apparatus is stopped is calculated by the off interval calculation 112. Depending on the off interval it is decided whether or not charging of the conductive medium K should be carried out in the preprocessing 114. And, the temperature of the platen glass is estimated by platen temperature calculation 115.

Figure 10:
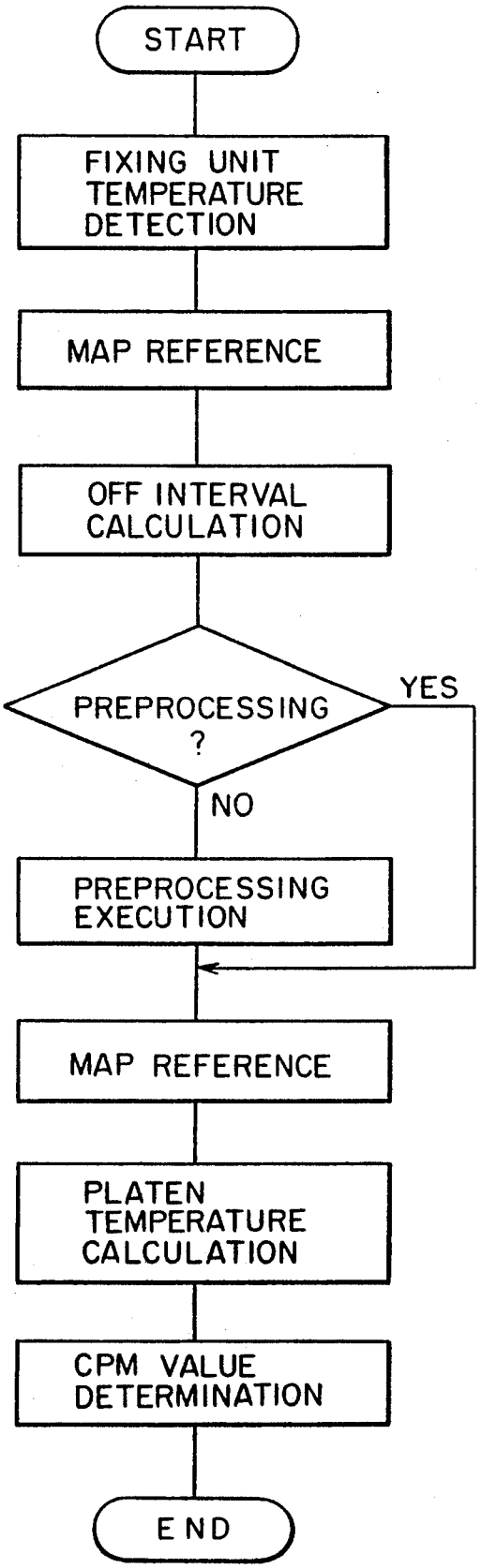
FIG. 10 is a flowchart of image formation according to the present invention.

The above processing is carried out in accordance with the flowchart shown in FIG. 10.

As understood from the above, an image forming apparatus according to the present invention is provided with means for measuring the off interval after the image forming apparatus is stopped and means for using the off interval and the predetermined heating characteristic of the platen glass to calculate the temperature of such parts as the photoreceptor and the platen glass. According to the present invention, therefore, no complicated special temperature sensor or clock is needed for obtaining the temperature of parts such as the photoreceptor and the platen glass.

For measuring the above-mentioned off interval, no clock is needed since the means for measuring it, according to the present invention, is constructed so that the off interval can be calculated by using the information on the temperature of an appropriate location having conspicuous temperature rise in the image forming apparatus and by using the predetermined heating change characteristic of the location.

The accuracy of measurement of the off interval can be increased according to the present invention by specifying the fixing unit as the location having conspicuous temperature rise, since using the heating characteristic of the unit this way achieves exact temperature control the unit requires.

The temperature detected near the fixing unit and the predetermined heating change characteristic of the fixing unit are used in order to calculate the off interval after the image forming apparatus is stopped. And then the off interval and the predetermined heating characteristic of the platen glass are used in order to calculate the temperature of the platen glass. Because of this feature, an image forming apparatus according to the present invention allows platen glass temperature to be measured without the use of any complicated special temperature sensor or clock.

On the basis of platen glass temperature measured by such a simple construction, therefore, it is possible with the present invention to speed up copying and produce copied images with proper print clarity, leading to increased efficiency of an image forming apparatus and its highly accurate control.

What is claimed is:

1. An image forming apparatus for reproducing an image with toner on a recording sheet, comprising:

means for holding a latent image corresponding to said image on a surface;

means for developing said latent image with toner;

means for transferring said developed latent image onto said recording sheet;

means for fixing said developed latent image on said recording sheet using heat;

means for heating said fixing means at a predetermined temperature, and for terminating the heating of said fixing means at a first time when an operation of said apparatus is ended;

means for detecting a temperature of said fixing means; and means for determining a first interval, between said first time and a second time at which said apparatus is reenergized, based upon said determined temperature.

2. The apparatus of claim 1, further comprising:

means for estimating a second interval between a third time at which said recording sheet is discharged from said fixing means and said first time; and means for estimating a third interval between said second time and a fourth time at which an operation of said apparatus is restarted.

3. The apparatus of claim 2, wherein said surface of said supporting means is charged to said predetermined electric potential when a total of said first interval, said second interval, and said third interval exceeds a predetermined interval.

4. The apparatus of claim 2, further comprising:

means for irradiating light on said original image so that a reflection image of said original image is obtained; and means for writing with variable intensity said latent image onto said supporting means with said reflection image;

wherein said writing means includes means for applying said reflection image at a lesser intensity for writing said latent image when a total interval of said first interval, said second interval, and said third interval exceeds a predetermined interval than when said total interval is within said predetermined interval.

5. The apparatus of claim 2, further comprising:

means for applying a bias electric charge of variable potential onto said supporting means, wherein said bias electric charge applying means includes means for applying a bias electric charge of lower potential onto said supporting means when a total interval of said first interval, said second interval, and said third interval exceeds a predetermined interval than when said total interval is within said predetermined interval.

6. The apparatus of claim 2, further comprising:

means for holding said document on a platen glass; and means for estimating a temperature of said platen glass based on said detected temperature of said fixing means.

7. The apparatus of claim 4, wherein said estimating means includes:

first memory means for storing first temperature transition data of said fixing means wherein a relation of a temperature transition of said fixing means to time is expressed in a data form; and second memory means for storing second temperature transition data of said platen glass wherein a relation of a temperature transition of said platen glass to time is expressed in data form.

* * * * *

UNITED STATES PATENT AND TRADEMARK OFFICE

CERTIFICATE OF CORRECTION

PATENT NO. : 5,162,855

DATED : November 10, 1992

INVENTOR(S) : Kiyohari Nakagawa, et al.

It is certified that error appears in the above-identified patent and that said Letters Patent is hereby corrected as shown below:

Claim 1, Column 13, Line 15, before "image" insert --original--;

Claim 1, Column 13, Line 16, change "holding" to --supporting--;

Claim 1, Column 13, Line 17, after "said" insert --original--;

Claim 1, Column 13, Line 29, change "determing" to --estimating--;

UNITED STATES PATENT AND TRADEMARK OFFICE

CERTIFICATE OF CORRECTION

PATENT NO. : 5,162,855
DATED : November 10, 1992
INVENTOR(S) : Kiyohari Nakagawa, et. al.

It is certified that error appears in the above-indentified patent and that said Letters Patent is hereby corrected as shown below:

Claim 1, Column 13, Line 31, change "determined" to --detected--.

Signed and Sealed this

Eleventh Day of January, 1994

Bruce Lehman

*Attest:*

BRUCE LEHMAN

*Attesting Officer*

*Commissioner of Patents and Trademarks*